United States Patent [19]

Miyamae

[11] 4,126,025

[45] Nov. 21, 1978

[54] LOCKING DEVICE

[75] Inventor: Yasuo Miyamae, Minanomachi, Japan

[73] Assignee: Sanpo Lock Co., Ltd., Tokyo, Japan

[21] Appl. No.: 784,825

[22] Filed: Apr. 5, 1977

Related U.S. Application Data

[63] Continuation of Ser. No. 613,973, Sep. 17, 1975, abandoned.

[30] Foreign Application Priority Data

Dec. 24, 1974 [JP] Japan ..... 50-195
Dec. 24, 1974 [JP] Japan ..... 50-196

[51] Int. Cl.[2] ..... E05B 19/14; E05B 27/06
[52] U.S. Cl. ..... 70/360; 70/401
[58] Field of Search ..... 70/358, 360, 361, 401, 70/407, 409

[56] References Cited

U.S. PATENT DOCUMENTS

| | | | |
|---|---|---|---|
| 570,032 | 10/1896 | Luebbers | 70/350 |
| 1,288,074 | 12/1918 | Lutz | 70/361 |
| 1,828,747 | 10/1931 | Perry | 70/361 |
| 2,620,649 | 12/1952 | Bernardo | 70/358 |
| 2,772,558 | 12/1956 | Gardner | 70/361 |
| 3,455,128 | 7/1969 | Tenkoff | 70/361 |

*Primary Examiner*—Robert L. Wolfe
*Attorney, Agent, or Firm*—Oblon, Fisher, Spivak, McClelland & Maier

[57] ABSTRACT

Disclosed is a locking device having an inner lock cylinder axially slidable in a recess in the lock housing. Tumbler means prevent relative motion between the cylinder and the housing until the axial insertion of a key with a double set of notches. Upon insertion thereof, the cylinder may be axially displaced only by pressure against the key to actuate the lock release.

2 Claims, 8 Drawing Figures

LOCKING DEVICE

This is a continuation of application Ser. No. 613,973, filed Sept. 17, 1975 and now abandoned.

BACKGROUND OF THE INVENTION

1. Field of the Invention

This invention relates generally to locking devices, and more particularly, to a locking device having an inner cylinder movable only axially with respect to the lock housing. When the tumblers in the cylinder are aligned with the interface of cylinder and housing upon insertion of the key, further axial pressure on the key actuates the lock release.

2. Description of the Prior Art

Conventional locking devices include a type generally designated cylinder locks which are designed to be opened by the insertion of a notched key and turning same. Rejection of a key occurs if either the notches on the shank do not effect proper alignment of the tumbler pins or if the grooves running longitudinally on the shank of the key do not correspond with mating protrusions at the entrance of the key hole. If the key is the proper one, insertion of the key must be followed by a turning of same to effect a rotation of the cylinder that actuates the lock release.

SUMMARY OF THE INVENTION

Accordingly, one object of this invention is to provide a locking device with a lock release actuatable by axial movement only of the key.

Another object of this invention is to provide a locking device requiring a key of non-standard cross-sectional shape with a plurality of notches.

A still further object of this invention is to provide a locking device having a plurality of tumbler sets, each of which must be actuated to release the lock mechanism.

BRIEF DESCRIPTION OF THE DRAWING

A more complete appreication of the invention and many of the attendant advantages thereof will be readily obtained as the same becomes better understood by reference to the following detailed description when considered in connection with the accompanying drawing, wherein.

DESCRIPTION OF A PREFERRED EMBODIMENT

Figure 1:
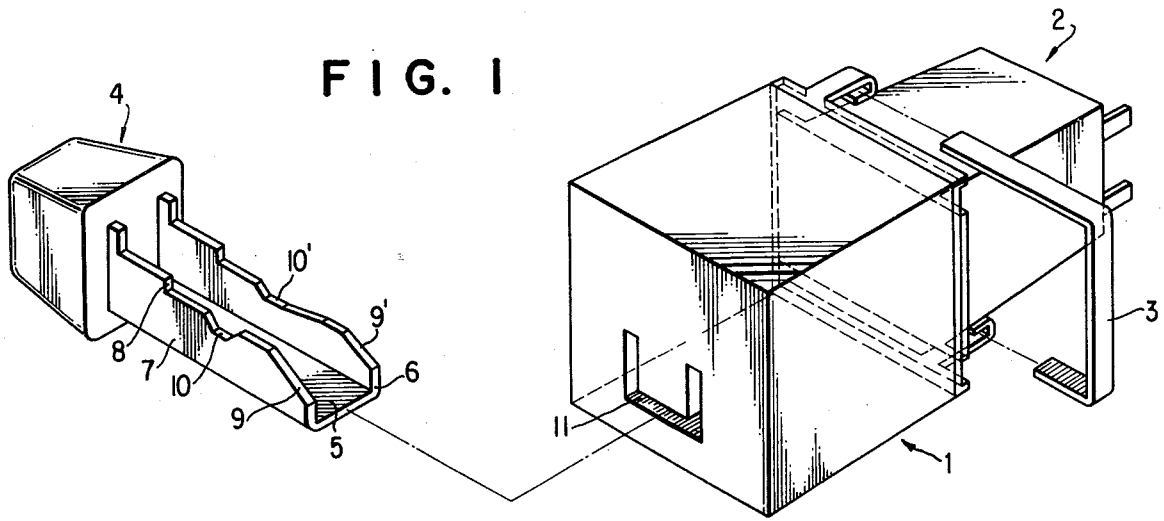
FIG. 1 is a perspective view of the lock housing and associated key.

With particular reference to FIG. 1, lock housing 1 is a generally cube shaped element, having attached thereto latch means 2 by connector 3. A generally U-shaped keyhole 11 is formed in the frontal face of lock housing 1.

Key 4 has a projecting, compound key shank 5 consisting of a first key shank 6 and a second key shank 7. The cross-sectional shape of key shank 5 is generally U-shaped to mate with keyhole 11. Each shank has formed thereon a key shank abutment 8, a tumbler camming surface 9 and one or more tumbler notches 10.

Figure 2:
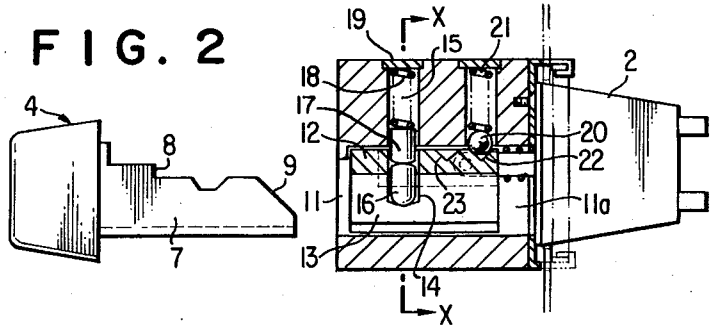
FIGS. 2 – 4 are cross-sectional side views of the locking device, sequentially illustrating the operation of one set of tumblers upon insertion of the key.

With particular reference to FIG. 2, keyhole 11 serves as the entrance point for recess 11*a* in lock housing 1. As visible in FIG. 8, recess 11*a* is generally rectangular when viewed in cross-section and the recess extends completely through the face of lock housing 1 that opposes the face containing keyhole 11.

Figure 8:
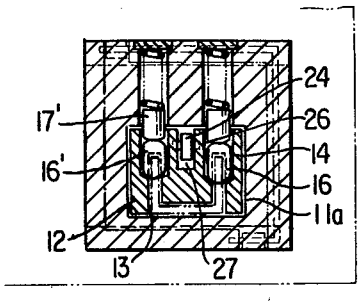
FIG. 8 is a cross-sectional front view of the locking device, taken on line X—X of FIG. 2.

Inner locking cylinder 12 is located within lock housing cylinder recess 11*a* and, with reference to FIG. 8, has a generally rectangular exterior configuration and includes key track 13 formed therein of a shape complementary to the shape of shank 5 of key 4. Additionally, and with reference to both FIGS. 3 & 8, the inner cylinder has formed therein a cylinder actuator recess 27 for a purpose to be described below. Inner cylinder 12 is longitudinally moveable in cylinder recess 11*a* relative to lock housing 1.

Inner cylinder 12 has formed therein a plurality of cylinder tumbler recesses 14, 14′, 14″. These cylindrical recesses are cut into inner cylinder 12 from the top surface thereof and are positioned such that they lie along both legs of cylinder key track 13. In the embodiment sectionally illustrated in FIGS. 2 and 5, three cylinder tumbler recesses are shown, but it is understood that a greater number of recesses may be formed if more complex tumbler and key patterns are desired. Corresponding housing tumbler recesses 15, 15′ and 15″ are formed in lock housing 1 by being drilled from the top surface of lock housing 1 through the housing into cylinder recess 11*a*. Each cylinder tumbler recess and housing tumbler recess holds a set of tumblers which may be designated as lower tumbler 16 and upper tumbler 17. Again, like reference numbers, primed, are used to denote the various pairs of tumblers in the various sets of recesses. Each recess contains a tumbler spring 18 which bears against tumbler recess plug 19 at its upper extremity and against one end of tumbler 17 at its lower extremity. Tumbler spring 18 thus tends to bias lower and upper tumbler sets 16 and 17 downwardly toward the bottom surface of cylinder tumbler recess 14. With particular reference to FIG. 8, it is noted that a portion of each of the lower tumblers 16 extends into key track 13 such that they may be contacted by key shank 5 when the key is inserted into the cylinder key track 13.

Attention is directed to the unequal sizes of each of lower tumblers 16, 16′ and 16″ as well as the unequal size of upper tumbler 17 when compared to upper tumblers 17′ and 17″. Because each cylinder tumbler recess 14 extends into inner cylinder 12 an equal amount, the unequal sizes of the upper and lower tumblers will cause their interfaces to lie at varying depths within the cylinder tumbler recesses 14. In each instance, at least a portion of upper tumbler 17 extends across the interface between inner cylinder 12 and the lock housing cylinder recess 11*a*. By so extending across this interface, relative motion between inner cylinder 12 and lock housing 1 is prevented. To effect such relative motion, it is necessary to align the interface of each set of tumblers 16 – 17 with the interface of inner cylinder 12 and lock housing cylinder recess 11*a*.

Figure 3:
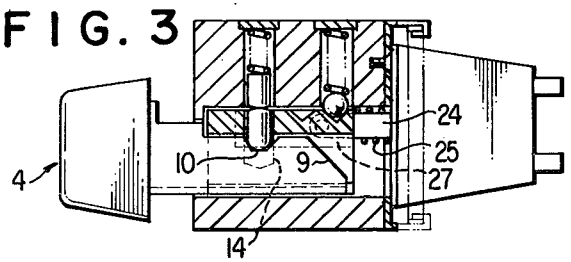
Figure 4:
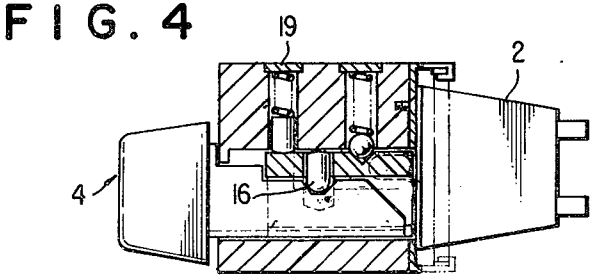
Figure 5:
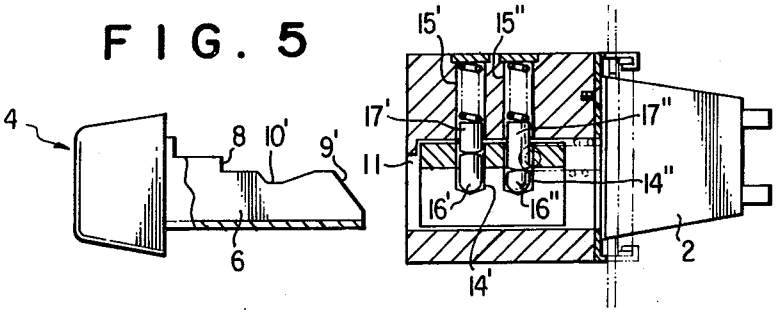
FIGS. 5 – 7 are cross-sectional side views of the locking device, sequentially illustrating the operation of another set of tumblers upon insertion of the key.
Figure 6:
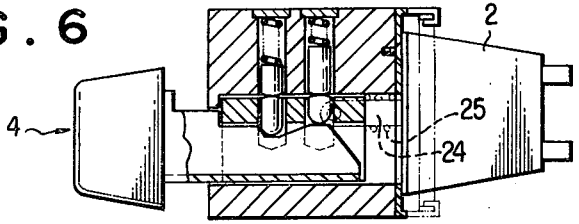
Figure 7:
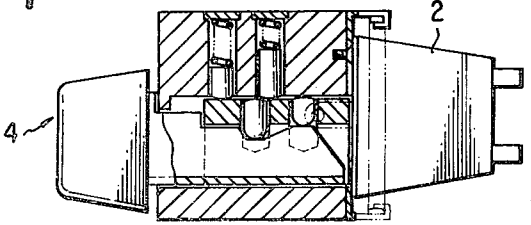

The tumbler actuation sequence is illustrated in FIGS. 2 – 4 with respect to the tumblers actuated by second key shank 7 and in FIGS. 5 – 7 for that of first key shank 6. Tumbler actuation is effected by the same mode of operation for both of the key shanks although it is emphasized that the unequal tumbler sizes require specific notch configurations on each key shank.

The operation of the tumblers may be observed sequentially in either FIGS. 2 - 4 or FIGS. 5 - 7. Taking FIGS. 5 - 7, by way of example, it is noted that in FIG. 5 two sets of tumblers 16' - 17' and 16" - 17" are illustrated as lying in cylinder and housing tumbler recesses 14' - 15' and 14" - 15", respectively. Tumbler 16' is longer than tumbler 16" and thus the interfaces between the individual tumblers of each set are located at different depths in the cylinder tumbler recesses.

Key 4 has, on the leading edge of first key shank 6, a camming surface 9'. With particular reference to FIG. 8, it will be noted that a portion of tumbler 16' is exposed in key track 13. Upon insertion of key 4 into keyhole 11, camming surface 9' strikes tumbler 16', thereby camming both tumblers 16' and 17' in an upwardly direction. The continued forward motion of key 4 enables camming surface 9' to then strike tumbler 16", again effecting an upward motion of both tumblers 16" and 17". With particular reference to FIG. 6, it is noted that the notches on first key shank 6 are positioned such that when the notch surfaces are in contact with the lowermost extremity of lower tumblers 16' and 16", the interface between tumblers 16' and 17' is aligned with the interface of inner cylinder 12 and lock housing cylinder recess 11*a*, and in like manner, the interface of the second set of tumblers is similarly aligned. In this position, key shank abutment 8 is in contact with the facing end of inner cylinder 12.

Further forward motion of key 4 displaces inner cylinder 12 in a longitudinal direction toward latch means 2.

Actuator rod 24, best visible in FIGS. 2, 3, and 8, is an element carried by latch means 2 having, on its end closest to inner cylinder 12, an actuator rod pin 26. The pin is perpendicular to the actuator rod and is fixedly attached to inner cylinder 12 within the cylinder actuator recess 27, so that actuator rod 24 and inner cylinder 12 move as a unit. Actuator rod spring 25 is helically wrapped around actuator rod 24 and, by bearing against latch means 2 and inner cylinder 12, tends to bias these two elements away from each other.

The further forward motion of key 4 that is possible after the tumbler sets are properly aligned causes key shank abutment 8 to bear against one end of inner cylinder 12 and move it longitudinally relative to the lock housing. This same forward motion causes actuator rod 24 to move into latch means 2 and release the latch. It is noted that the latch means 2 illustrated in the accompanying drawings is a type employing an electric circuit with actuator rod 24 acting as a switch means to open and close the circuit. One use for such a latch means would be in a machine such as a cash register in which it may be used as a guard switch for preventing unauthorized access to the register. It is understood that any latch means, either electrical or mechanical, may be employed with the locking device disclosed herein.

An additional feature of the instant invention is a detent means providing positive positioning and, optionally, an audible click at the position of release of latch means 2. With particular reference to FIGS. 2, 3, and 4, spherical detent ball 20 is located within a through hole cut in lock housing 1 similarly to housing tumbler recesses 15, etc. The upper end of the recess is sealed with a plug and detent spring 21 bears at its upper extremity against this plug and at its lower extremity against detent ball 20. First detent recess 22 and second detent recess 23 are cut in the upper surface of inner cylinder 12 and are positioned such that detent ball 20 rests in first detent recess 22 when the locking device is in its locked position, but detent ball 20 rests in second detent recess 23 when the locking device is in its unlocked position. Detent spring 21 is a relatively weak spring so that the biasing force against detent ball, 20 when it is in second detent recess 23, is small enough to be overcome by the biasing force of actuator rod spring 25, thereby permitting the inner lock cylinder to return to its locked position under the influence thereof when key 4 is removed.

It is to be understood that although pin tumblers are illustrated in the accompanying drawings, other well known equivalents, such as disc tumblers, may be employed.

Obviously, numerous modifications and variations of the present invention are possible in light of the above teaching. It is therefore to be understood that within the scope of the appended claims the invention may be practiced otherwise than as specifically described herein.

I claim:

1. A locking device which comprises:

a housing having a recess therein and a keyhole which has a U-shaped cross-section and communicates with the recess;

a lock cylinder disposed within the recess of said housing being longitudinally and non-rotatably movable therein, the lock cylinder having a key track of the same U-shaped cross-section as the keyhole;

a plurality of tumbler sets carried by said housing and said lock cylinder and overlying one leg of the U-shaped key track, said tumbler sets being normally biased to positions wherein their interfaces do not coincide with the interface of said lock cylinder and said housing, whereby relative motion therebetween is precluded, and being key actuatable to positions whereby said lock cylinder can then be longitudinally moved with respect to said housing to release a lock;

detent means overlying the other leg of the U-shaped key track, including at least a first and second detent in said lock cylinder and a detent element disposed in a hole in said housing, said detent element being spring-biased in the direction of said detents, for providing positive positioning of the lock cylinder with respect to said housing when said lock cylinder is moved longitudinally therewithin such that the locking device is in a locked or unlocked position;

a latch means attached to said lock housing;

actuator means disposed in said lock housing and extending into said latch means and being responsive to longitudinal movement of said lock cylinder for moving into said latch means and releasing same wherein said actuator means comprises an actuator rod carried by said latch means and an actuator rod pin member fixedly attached to said lock cylinder such that said actuator rod and said lock cylinder move unitarily; and spring biasing means helically mounted on said actuator rod and disposed between said latch means and said lock cylinder for normally biasing said latch means and said lock cylinder away from each other and for urging said lock cylinder in the direction of said keyhole to a locked position, the biasing force on said tumbler sets urging said tumbler sets to their normal position being relatively weak compared to the force of said spring biasing means between said latch means and said lock cylinder, whereby said lock cylinder is automatically returned to said locked position by said spring biasing means when an actuating key is removed from said keyhole and said key track.

2. The locking device of claim 1, wherein said latch means includes a circuit means and said actuator means is a switch for said circuit means.

* * * * *